US011387529B2

(12) United States Patent
Algaba Brazalez et al.

(10) Patent No.: US 11,387,529 B2
(45) Date of Patent: Jul. 12, 2022

(54) WAVEGUIDES INTERCONNECTED BY FLANGES HAVING GLIDE SYMMETRICALLY POSITIONED HOLES DISPOSED THEREIN

(71) Applicant: Telefonaktiebolaget LM Ericsson (publ), Stockholm (SE)

(72) Inventors: Astrid Algaba Brazalez, Gothenburg (SE); Lars Manholm, Gothenburg (SE); Oscar Quevedo-Teruel, Stockholm (SE); Mahsa Ebrahimpouri Hamlkar, Stockholm (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 37 days.

(21) Appl. No.: 16/647,891

(22) PCT Filed: Oct. 13, 2017

(86) PCT No.: PCT/EP2017/076187
§ 371 (c)(1),
(2) Date: Mar. 17, 2020

(87) PCT Pub. No.: WO2019/072399
PCT Pub. Date: Apr. 18, 2019

(65) Prior Publication Data
US 2020/0220245 A1 Jul. 9, 2020

(51) Int. Cl.
*H01P 1/04* (2006.01)
*H01P 3/12* (2006.01)
(Continued)

(52) U.S. Cl.
CPC ..... *H01P 1/042* (2013.01); *H01P 1/2005* (2013.01); *H01P 3/12* (2013.01); *H01P 11/002* (2013.01)

(58) Field of Classification Search
CPC ..... H01P 1/042
(Continued)

(56) References Cited

U.S. PATENT DOCUMENTS 3,201,725 A * 8/1965 Johnson ..... H01P 1/042 333/254
7,791,438 B2 * 9/2010 Lau et al. ..... H01P 1/042 333/254
(Continued)

FOREIGN PATENT DOCUMENTS

WO 2014174494 A2 10/2014

OTHER PUBLICATIONS

Rahiminejad, S. et al., "Micromachined Contactless Pin-Flange Adapter for Robust High-Frequency Measurements", Journal of Micromechanics and Microengineering, vol. 24 No. 8, Jul. 22, 2014, pp. 1-12, IOP.
(Continued)

*Primary Examiner* — Benny T Lee
(74) *Attorney, Agent, or Firm* — Coats & Bennett, PLLC

(57) ABSTRACT

The embodiments herein relate to a first waveguide comprising a first flange (103*a*) surrounding an end opening (105*a*) of the first waveguide (101*a*). The first flange (103*a*) comprises at least two holes (110) which are periodically distributed around the end opening (105*a*). The first waveguide (101*a*) is arranged to be connected to a second waveguide (101*b*) by connecting the first flange (103*a*) to a second flange (103*b*) of the second waveguide (101*b*) such that the end opening (105*a*) of the first waveguide (101*a*) faces an end opening (105*b*) of the second waveguide (101*b*) and such that the holes (110) in the first flange (103*a*) are at least partly glide symmetrically positioned with respect to holes (110) which are periodically distributed around the end opening (105*b*) of the second flange (103b).

20 Claims, 11 Drawing Sheets

(51) Int. Cl.
*H01P 11/00* (2006.01)
*H01P 1/20* (2006.01)

(58) Field of Classification Search
USPC ..... 333/254
See application file for complete search history.

(56) References Cited

U.S. PATENT DOCUMENTS

2011/0280518 A1* 11/2011 Wollack et al. ..... H01P 1/00 385/50
2013/0342288 A1 12/2013 Lau
2019/0372188 A1* 12/2019 Wagner et al. ..... H01P 5/022

OTHER PUBLICATIONS

Ebrahimpouri, M. et al., "Design Guidelines for Gap Waveguide Technology Based on Glide-Symmetric Holey Structures", IEEE Microwave and Wireless Components Letters, vol. 27 No. 6, Jun. 1, 2017, pp. 542-544, IEEE.
Ebrahimpouri, M. et al., "Low-Cost Metasurface Using Glide Symmetry for Integrated Waveguides", 2016 10th European Conference on Antennas and Propagation (EuCAP), Apr. 10, 2016, pp. 1-2, IEEE.
Quevedo-Teruel, O. et al., "Ultrawideband Metasurface Lenses Based on Off-Shifted Opposite Layers", IEEE Antennas and Wireless Propagation Letters, vol. 15, Oct. 26, 2016, pp. 484-487, IEEE.
Ebrahimpouri, M. et al., "Cost-Effective Gap Waveguide Technology Based on Glide-Symmetric Holey EBG Structures", Transactions on Microwave Theory and Techniques, Nov. 1, 2017, pp. 927-934, IEEE.

* cited by examiner

WAVEGUIDES INTERCONNECTED BY FLANGES HAVING GLIDE SYMMETRICALLY POSITIONED HOLES DISPOSED THEREIN

BACKGROUND

A waveguide is a device or a guide through which electromagnetic currents are guided. The waveguide typically comprises a hollow tube or pipe, and is therefore also referred to as a "hollow waveguide". The hollow tube may be circular, rectangular or have any other suitable shape. The waveguide has a hollow centre and conductive walls defining the centre of the waveguide. The diameter of the waveguide and the wavelength of the electromagnetic wave traveling in the waveguide are closely related such that if the frequency of the wave is too low, then the electromagnetic wave cannot propagate through the waveguide.

Hollow waveguides have been widely used as a hardware standard technology for the design of passive microwave components and antenna arrays. Such hollow waveguides are entirely made of metal and exhibit attractive features like low loss, good isolation properties and high power handling capability. A common application of hollow waveguides is to be used as a standard interconnection interface of high frequency circuits for lab testing purposes. In such cases, the waveguide typically comprises a flange. There are different types of waveguide flanges, and some of them will be described below. The surface of a waveguide flange (e.g., made of metal) should be smooth and clean in order to let the electromagnetic currents suitably flow along the two waveguides joined together without any leakage or reflection. Additional versions of waveguide flanges provide a texture pattern around the waveguide opening to facilitate the flow of electromagnetic currents between the waveguide joints without leaking energy. One example is the choke flange that contains a corrugation that establishes a high impedance condition at the contact point between the flanges that is transformed into a short-circuit at the side-edges of the waveguide opening by using a Ag/4 section. Ag represents the guided (g) wavelength (A) of the wave propagating in the parallel plate waveguide region between the two flanges. Therefore, the current flows smoothly across the joint between two waveguides without leaking. Another waveguide flange type is the so-called pin-flange adapter where a pin surface surrounding the waveguide opening in one of the flanges avoids any possible power loss when screwed together with a smooth waveguide flange in the presence of a gap between the pin-flange and the smooth flange. See S. Rahiminejad, E. Pucci, S. Haasl, and P. Enoksson, "Micromachined contactless pin-flange adapter for robust high-frequency measurements", Journal of Micromachining and Microengineering, vol. 24, no. 8, 2014.

An example of a traditional flange of a rectangular waveguide for measurement purposes is illustrated in FIG. 1. The waveguide is referred to as a rectangular waveguide because the opening has a rectangular shape. The left part of FIG. 1 illustrates a waveguide assembly where three waveguides 1101*a*, 1101*b*, 1101*c* are connected together, and the right part of FIG. 1 provides a more detailed illustration of some of the flanges comprised in the waveguide assembly. FIG. 1 illustrates an example where the three waveguides 101*a*, 101*b*, 101*c* are rectangular tubes. As seen in FIG. 1, a first waveguide 101*a* comprises a first flange 103*a* surrounding an end opening 105*a* in one end of the first waveguide 101*a*. A second waveguide 101*b* comprises a second flange 103*b* surrounding an end opening 105*b* in one end of the second waveguide 101*b*. The first waveguide 101*a* is connected to the second waveguide 101*b* by connecting the first flange 103*a* to the second flange 103*b* so that the end openings 105*a*, 105*b* face each other. The first and second flange 103*a*, 103*b* may be connected to each other by using for example screws or other suitable connecting means. Furthermore, FIG. 1 illustrates that the second waveguide 101*b* comprises a third flange 103*c* surrounding an end opening in the opposite end of the second waveguide 101*b* as compared to the second flange 103*b*. The second waveguide 101*b* may be a Device Under Test (DUT). A third waveguide 101*c* comprises a fourth flange 103*d* surrounding an end opening of the third waveguide 101*c*. The third waveguide 101*c* is connected to the second waveguide 101*b* by connecting the fourth flange 103*d* to the third flange 103*c*. The end openings 105*a*, 105*b* are illustrated as a rectangular openings due to that the waveguide is formed as a rectangular tube.

As seen in the right part of FIG. 1, each flange 103*a*, 103*b*, 103*c*, 103*d* are circular flat disks having a smooth surface and having a respective end opening 105*a*, 105*b* in the center of the disk. Each flange 103*a*, 103*b*, 103*c*, 103*d* is located around the outer circumference of the end part of the respective waveguide 101*a*, 101*b*, 101*c*. The surface of the waveguide flange (e.g. made of metal) should be smooth and clean in order to let the electromagnetic currents suitably flow along the two waveguides joined together without any leakage or reflection. Tolerances or errors when mating to flanges 103*a* and 103*b* and mating flanges 103*c* and 103*d* can cause gaps 112 between the flange surfaces. The errors and gaps 112 can be created by screwing the flanges carelessly or not tightening them well. The gaps 112 may cause leakage, reflections, and measurement uncertainties.

Both the flat flange and the choke flange need to be carefully mated to ensure a good electrical contact. The term mated may also be described as connected, joined, coupled etc. This is usually done by screwing, which is time consuming and laborious. The pin flange and the choke flange both need very accurate fabrication methods, which limits their use at higher frequencies since the dimensions of the corrugations and the pins become very small. Therefore, there is a need to at least mitigate or solve this issue.

SUMMARY OF THE INVENTION

An objective of embodiments herein is therefore to obviate at least one of the above disadvantages and to provide an improved waveguide interconnection.

According to a first aspect, the object is achieved by a first waveguide comprising a first flange surrounding an end opening of the first waveguide. The first flange comprises at least two holes which are periodically distributed around the end opening. The first waveguide is arranged to be connected to a second waveguide by connecting the first flange to a second flange of the second waveguide such that the end opening of the first waveguide faces an end opening of the second waveguide and such that the holes in the first flange are at least partly glide symmetrically positioned with respect to holes which are periodically distributed around the end opening of the second flange.

According to a second aspect, the object is achieved by a waveguide assembly for waveguides. The waveguide assembly comprises a first waveguide comprising a first flange surrounding an end opening of the first waveguide. The waveguide assembly further comprises a second waveguide comprising a second flange surrounding an end opening of the second waveguide. Each flange comprises at least two holes which are periodically distributed around the respective end opening. The first and second waveguides are arranged to be connected to each other by connecting the first flange to the second flanges such that the end openings face each other and such that the holes in the first flange are at least partly glide symmetrically positioned with respect to the holes in the second flange.

According to a third aspect, the object is achieved by a method for manufacturing a first waveguide. The method comprises providing a first flange surrounding an end opening to the first waveguide. The first flange comprises at least two holes which are periodically distributed around the end opening. The first waveguide is arranged to be connected to a second waveguide by connecting the first flange to a second flange of the second waveguide such that the end opening of the first waveguide face an end opening of the second waveguide and such that the holes in the first flange are at least partly glide symmetrically positioned with respect to holes which are periodically distributed around the end opening of the second flange.

According to a fourth aspect, the object is achieved by a method for manufacturing a waveguide assembly for waveguides. The method comprises providing a first waveguide comprising a first flange surrounding an end opening of the first waveguide. The method further comprises providing a second waveguide comprising a second flange surrounding an end opening of the second waveguide. Each flange comprises at least two holes which are periodically distributed around the respective end opening. The method further comprises connecting the first and second waveguides to each other by connecting the first flange to the second flanges such that the end openings face each other and such that the holes in the first flange are at least partly glide symmetrically positioned with respect to the holes in the second flange.

An improved waveguide interconnection is provided since each flange comprises at least two holes which are periodically distributed around the respective end opening, and since the first and second waveguides are configured to be connected to each other by connecting the first flange to the second flanges such that the end openings face each other and such that the holes in the first flange are at least partly glide symmetrically positioned with respect to the holes in the second flange.

Embodiments herein afford many advantages, of which a non-exhaustive list of examples follows:

A glide symmetric structure is a periodic pattern generated by two geometrical transformations: a translation and a reflection with respect to a certain reference plane. It has been found that by using holes as unit cell of this glide symmetric structure, a wideband stopband where all higher-order modes are avoided is achieved. When this structure is integrated surrounding a waveguide flange opening, an advantage of the embodiments herein is that any possible leakage of signals with frequencies within the stop band due to a gap between the flange joints is eliminated and a smooth transition is achieved.

Only one row of holes surrounding the waveguide opening is enough to prevent leakage and provides almost perfect transmission, thereby the embodiments herein haVE an advantage of simplifying the waveguide since it is not necessary to apply several rows of holes in the holey flange configuration as compared to a pin-type flange which has several rows of pins.

Another advantage of the embodiments herein is that the holes can be made by just drilling, which is much simpler and cost-effective than milling pins or corrugations.

There is a minimum required depth of the holes but as long as the depth is larger than the minimum required depth, the depth does not affect the stopband. This provides an advantage of a non-sensitivity tolerance to the depth of the hole. Moreover, the depth of the hole is smaller than the pin height in the pin-flange, which should be around $\lambda/4$ ($\lambda$ represents the wavelength) in order to create an open boundary condition, so the holey flange can be made smaller (thinner) than the pin flange.

A further advantage of the embodiments herein is that the performance of the at least partly glide symmetric holey structure is insensitive to the flatness of the bottom of the hole, which provides manufacturing flexibility since the drill could have a conical shape and the holey flange still performs as expected.

The period and hole dimensions in the embodiments herein are larger than the required ones in a pin-type Electromagnetic bandgap (EBG) structure for operating at the same center frequency. A larger period means an advantage of less sensitivity to manufacturing tolerances and misalignments. For example, at a center frequency of 60 GHz, it has been seen that misalignments of 0.2 mm do not affect its performance.

If the number of holes surrounding the waveguide is even, the holes can be placed in an anti-symmetric topology so that the need of fabricating two different male and female holey flange adapters is avoided. In this way, the embodiments herein have an advantage of that both flanges are manufactured identical and when the flanges are joined together the geometry is built-up at least partly glide symmetrical. This fact simplifies the manufacturing and use since there is only one variant of flange.

The embodiments herein provide the additional advantage of that the at least partly glide symmetric holey flange reduces leakage independently of if the surface of the flange is flat or if the surface of the flange has a bulge.

Furthermore, the embodiments herein provide the advantage of that the at least partly glide symmetric holey pattern reduces any leakage independently on how the holes are distributed around the waveguide opening (the hole topology can be rounded, elliptical, square etc.).

The embodiments herein are not limited to the features and advantages mentioned above. A person skilled in the art will recognize additional features and advantages upon reading the following detailed description.

BRIEF DESCRIPTION OF THE DRAWINGS

The embodiments herein will now be further described in more detail in the following detailed description by reference to the appended drawings illustrating the embodiments and in which.

The drawings are not necessarily to scale and the dimensions of certain features may have been exaggerated for the sake of clarity. Emphasis is instead placed upon illustrating the principle of the embodiments herein.

DETAILED DESCRIPTION OF THE INVENTIOIN

The embodiments herein relates to a waveguide with an at least partly glide symmetric holey pattern surrounding the waveguide end opening.

Figure 1:
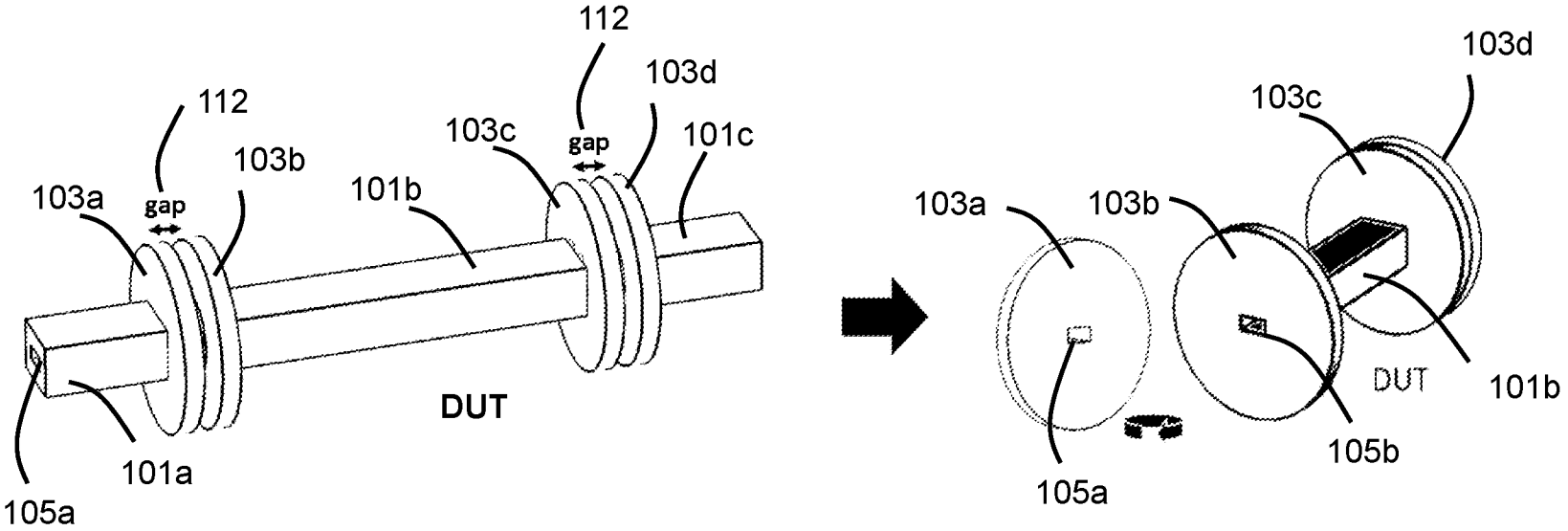
Fig. 1 (prior art)
FIG. 1 is a schematic drawing illustrating an example embodiment of a waveguide assembly.
Figure 2:
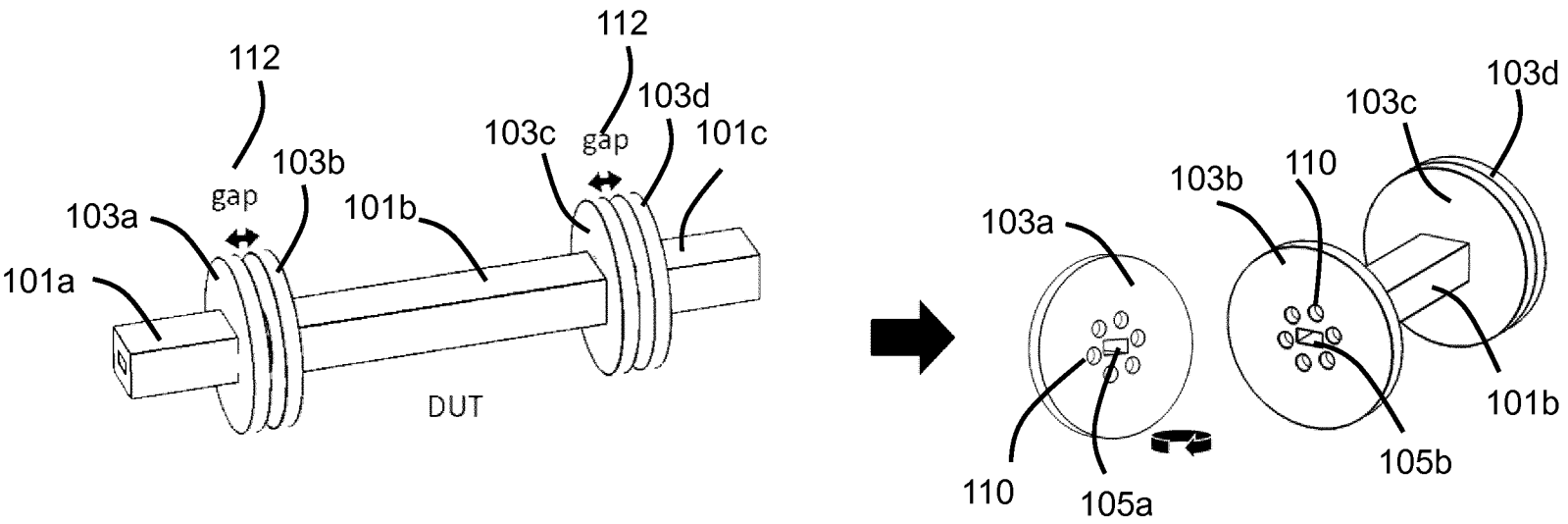
FIG. 2 is a schematic drawing illustrating an example embodiment of a waveguide assembly.

FIG. 2 illustrates an example embodiment of a waveguide assembly. A waveguide assembly may be described as waveguides connected to each other via flanges. The left part of FIG. 2 illustrates a waveguide assembly where three waveguides 101*a*, 101*b*, 101*c* are connected together, and the right part of FIG. 2 provides a more detailed illustration of some of the flanges comprised in the waveguide assembly. FIG. 2 illustrates an example where the three waveguides 101*a*, 101*b*, 101*c* are hollow tubes having a rectangular form, thus the waveguide can be referred to as a "hollow waveguide".

As seen in FIG. 2, a first waveguide 101*a* comprises a first flange 103*a* surrounding an end opening 105*a* in one end of the first waveguide 101*a*. A second waveguide 101*b* comprises a second flange 103*b* surrounding an end opening 105*b* in one end of the second waveguide 101*b*. The first waveguide 101*a* is connected to the second waveguide 101*b* by connecting the first flange 103*a* to the second flange 103*b* so that the end openings face each other. Furthermore, FIG. 2 illustrates that the second waveguide 101*b* comprises a third flange 103*c* surrounding an end opening in the opposite end of the second waveguide 101*b* as compared to the second flange 103*b*. The second waveguide 101*b* may be a DUT. A third waveguide 101*c* comprises a fourth flange 103*d* surrounding and end opening (not shown) of the third waveguide 101*c*. The third waveguide 101*c* is connected to the second waveguide 101*b* by connecting the fourth flange 103*d* to the third flange 103*c*. The end openings 105*a*, 105*b* are illustrated as a rectangular opening due to the fact that the waveguides 101*a*, 101*b*, 101*c* are formed as rectangular tubes. However, any other suitable shape of the waveguide is applicable such as e.g. a circular tube. The end openings 105*a*, 105*b* have a shape which corresponds to the shape of the waveguide (i.e., the tube which comprises the waveguide).

When the reference number 101 is used without the letters a, b or c, it refers to any of the waveguides in the assembly. When the reference number 103 is used without the letters a, b, c or d, it refers to any of the flanges in any of the waveguides 101. Similarly, when the reference number 105 is used without the letters a or b, it refers to any of the end openings in any of the waveguides 101.

Considering an example where two waveguides 101 are connected to each other (e.g. the first waveguide 101*a* and the second waveguide 101*b*) in an at least partly glide symmetrical way. This means the holes 110 in the first flange 103*a* are at least partly glide symmetrically positioned with respect to the holes 110 in the second flange 103*b*. The holes 110 in the first flange 103*a* are not necessarily directly placed opposite to the holes 110 in the second flange 103*b* when the flanges 103*a*, 103*b* are connected, but the holes 110 in the first flange 103*a* at least partly overlap with the holes 110 in the second flange 103*b*. In other words, the holes 110 in one flange 103 can glide a certain amount with respect to the holes 110 in the other flange 103 when the flanges 103*a*, 103*b* are connected, e.g., they can glide by up to half a period. The term "at least partly glide symmetric" refers to the fact that the structure may be completely glide symmetric, or quasi glide symmetric. The term "quasi glide symmetric" refers to having a small deviation from the exact glide symmetric structure, for example quasi glide symmetric refers to the case that one flange 103 has moved slightly more than half periodicity. "Quasi periodic structure" refers to the case that the periodicity of the next rows or the dimensions of the holes 110 in next row change slightly. A quasi periodic structure may be described as a structure where the dimensions of the holes 110 changes slightly from flange 103 to flange 103. A quasi periodic structure is a structure that is ordered but not periodic. Thus, the at least partly glide symmetric structure may be referred to as an "at least partly quasi periodic structure having complementary holes" 110.

Note that the waveguide assembly illustrated in FIG. 2 which comprises three connected waveguides 101*a*, 101*b*, 101*c* is only an example. A waveguide assembly can comprise any other suitable number of waveguides from two and upwards. For example, the waveguide assembly may comprise the first and second waveguides 101*a*, 101*b* where the first flange 103*a* is arranged to be connected to the second flange 103*b*.

As seen in the right part of FIG. 2, each flange 103 surrounds the end opening 105 of the respective waveguide 101. The end opening 105 may be located substantially in the center of the flanges 103.

Each flange 103 is provided with at least two holes 110 which surround the respective end opening 105. The at least two holes 110 are periodically distributed around the respective end opening 105. Each flange 103 is located around the outer circumference of the end part of the respective waveguide 101. A hole 110 may also be referred to as a "groove", "recess", "aperture", "opening", "orifice", "perforation"or "slit". The hole has any suitable diameter and depth, and these parameters may be in relation to the frequency band in which the waveguide operates.

FIG. 2 illustrates that there may be a gap 112 between the flanges 103 when the flanges 103 are connected to each other. In other examples, there is no gap between the connected flanges 103. The gap 112 may be of any length, e.g., zero or more. By embedding an end opening 105 with one row of holes 110, there is no need to worry about the presence of a small gap 112 when screwing the two flanges 103 together. Nevertheless, those of skill in the art will note that the smaller the gap 112, the wider operating bandwidth of the at least partly glide symmetric holey structure is achieved (see FIG. 9 which is described below).

Figure 3:
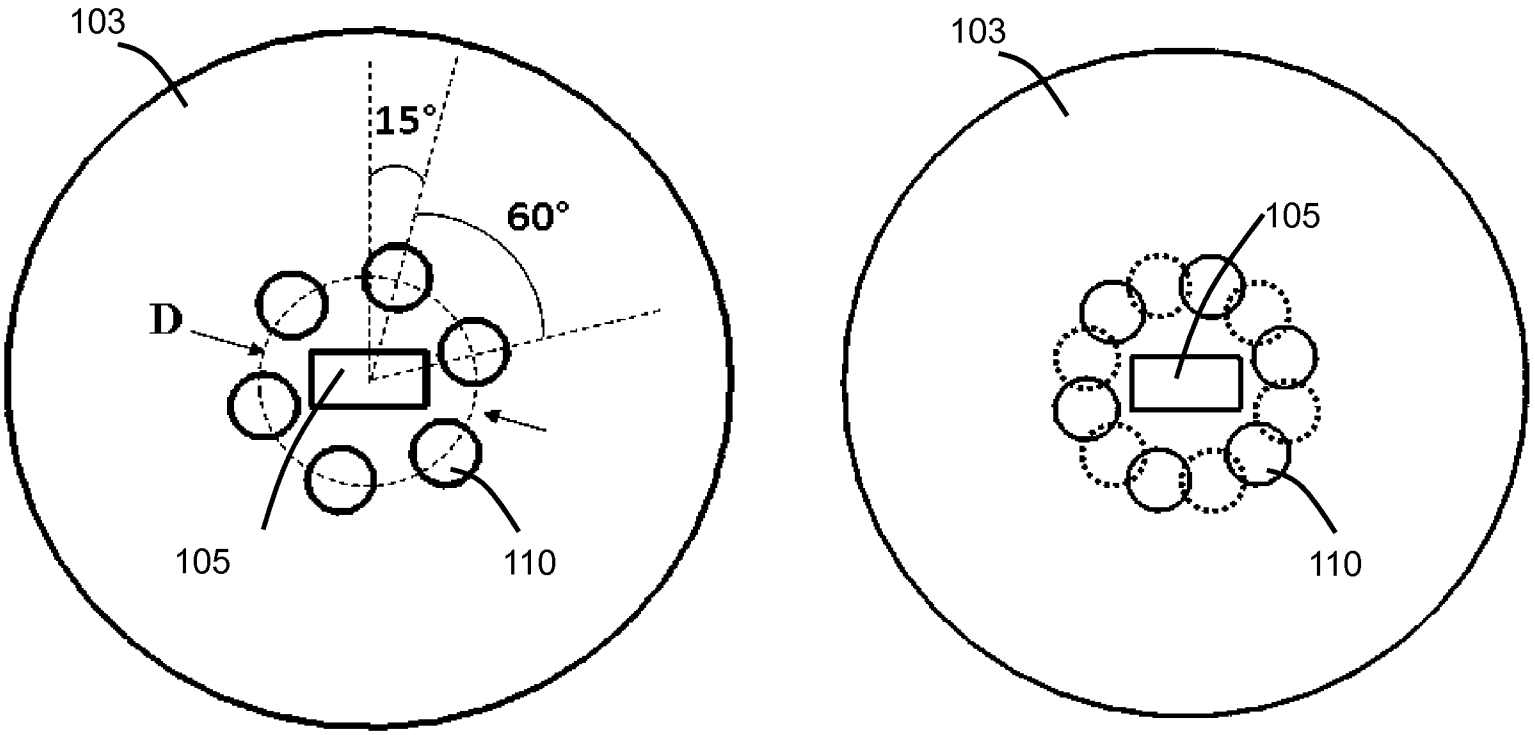
FIG. 3 is a schematic drawing illustrating an example embodiment of the flange.

There can be any number of holes 110 from two and upwards and at any distance from the end opening 105. FIG. 3 illustrates an example of a flange 103 having six holes 110. However, each flange 103 may have any other (even or odd) number of holes 110 greater than two. The holes 110 drawn with continuous lines are the holes 110 located on the flange 103 which is seen in the figure, and the holes 110 drawn with dotted lines are the holes 110 located on the other flange 103, i.e. the flange 103 on the other waveguide 101 which is not shown in the figure. The continuous and dotted drawn holes also apply to FIGS. 4-7 described below. The periodicity of the holes 110 may be dependent on the stopband.

The left part of FIG. 3 illustrates an example of the position of the holes 110, and the right part of FIG. 3 illustrates how the holes 110 in the two mating flanges 103 are placed relative to each other. The holes 110 in FIG. 3 are placed around a circle with diameter D of 9 mm. Note that 9 mm is only an example diameter and is for an example frequency of 60 GHz. The diameter can be scaled to any other frequency by scaling the relevant parameters, such as hold diameter, hole depth, periodicity of a unit cell, gap width, and the like. Another example may be in the U band. See also M. Ebrahimpouri, O. Quevedo-Teruel and E. Rajo-Iglesias, "Design guidelines for gap waveguide technology based on glide symmetric holey structures," in IEEE Microwave and Wireless Component Letters, vol. 27, no. 6, 2017 for additional details regarding the diameter and frequency. The holes 110 can be positioned at any angle from the center, i.e. the end opening 105. FIG. 3 illustrates an example where the holes 110 are positioned at an angle of 15° from the end opening 105 and where the angle between two neighboring holes 110 is 60°. Specifically, they can be drilled in symmetric topology so that it is possible to avoid fabricating two different topologies to have complementary holes 110 on different flanges 103. In this way, both flanges 103 are manufactured identically and when the flanges 103 are joined together the geometry is built-up at least partly glide symmetrically (see the right part of FIG. 3). This fact simplifies the manufacturing process.

Figure 4:
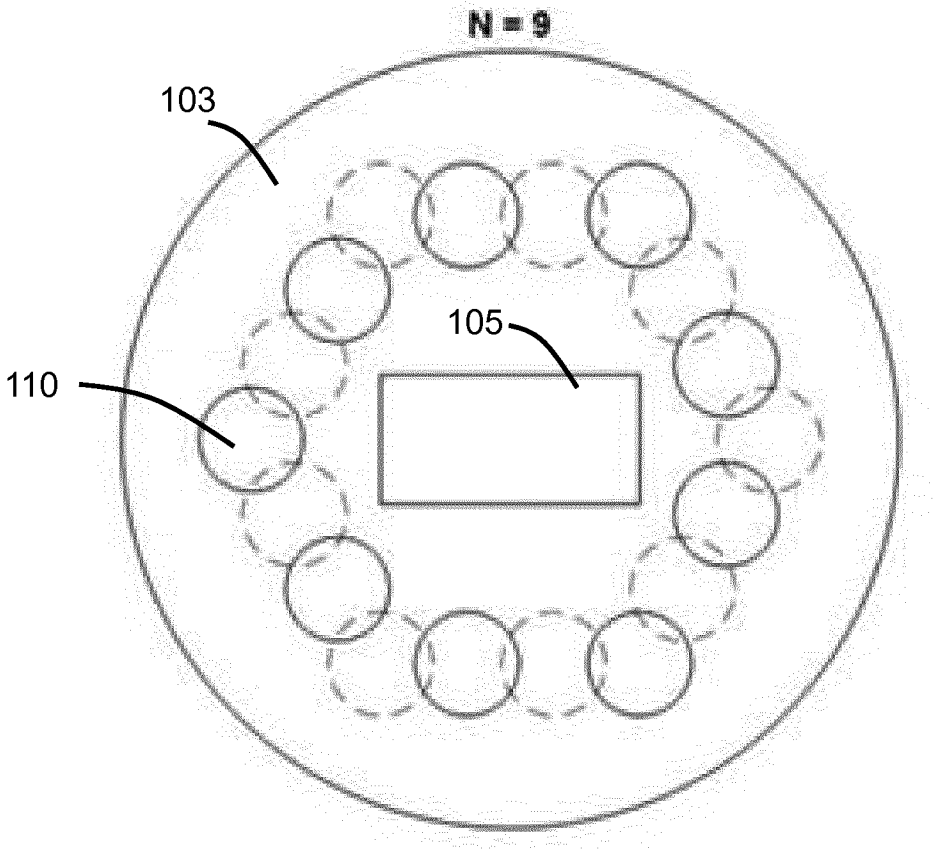
FIG. 4 is a schematic drawing illustrating an example embodiment of the flange.

The holes 110 can be placed in a circular geometry, as exemplified in FIG. 3, but generally, along any closed shape surrounding the end opening 105, e.g., a rectangle, hexagon, or any polygon. FIG. 4 illustrates an example with N=9 circular holes 110 on each flange 103, and where the holes 110 are placed in a hexagonal closed shape surrounding the end opening 105.

Figure 5:
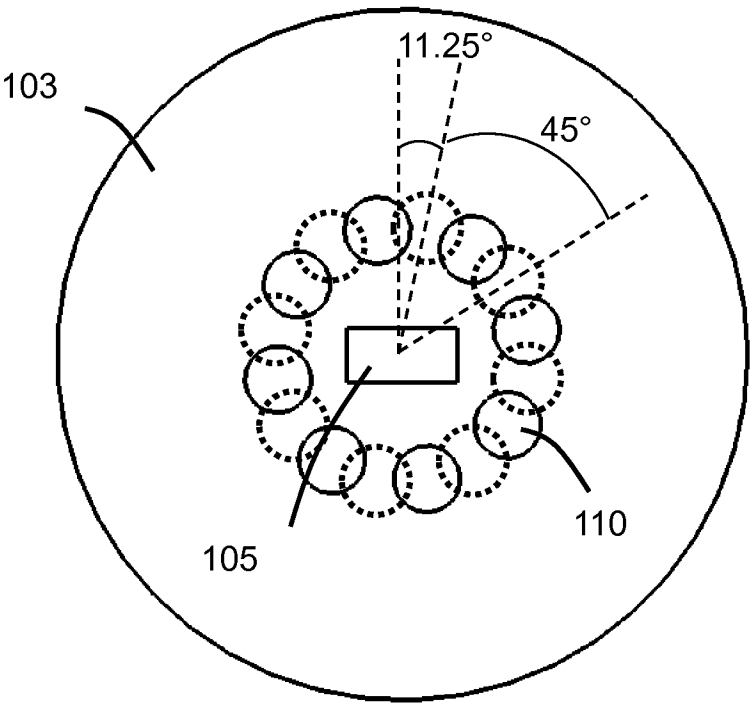
FIG. 5 is a schematic drawing illustrating an example embodiment of the flange.

FIG. 5 illustrates an example where each flange 103 comprises 18 holes 110. FIG. 5 also shows an example of the position of the holes 110 on the flanges 103. The rotation angle (i.e. the rotation angle is the angle between the center of one hole 110 and the center of another hole 110 on the same flange 103) and the deviation angle (i.e. the deviation angle is the angle from the center of the flange 103 and the center of a hole 110) associated with the holes 110 can be calculated using the following formulas:

$$\text{Rotation angle} = \frac{360°}{\text{Number of holes on each flange}}$$

$$\text{Deviation angle} = \frac{\frac{360°}{\text{Number of holes on each flange}}}{4}$$

For 8 holes 110 on each flange 103, the angles may be calculated as follows:

$$\text{Rotation angle} = \frac{360^\circ}{8} = 45^\circ$$

$$\text{Deviation angle} = \frac{\frac{360^\circ}{8}}{4} = \frac{45^\circ}{4} = 11.25°$$

For 6 holes 110 on each flange 103, the angles may be calculated as follows:

$$\text{Rotation angle} = \frac{360^\circ}{6} = 60^\circ$$

$$\text{Deviation angle} = \frac{\frac{360^\circ}{6}}{4} = \frac{60^\circ}{4} = 15°$$

Figure 6:
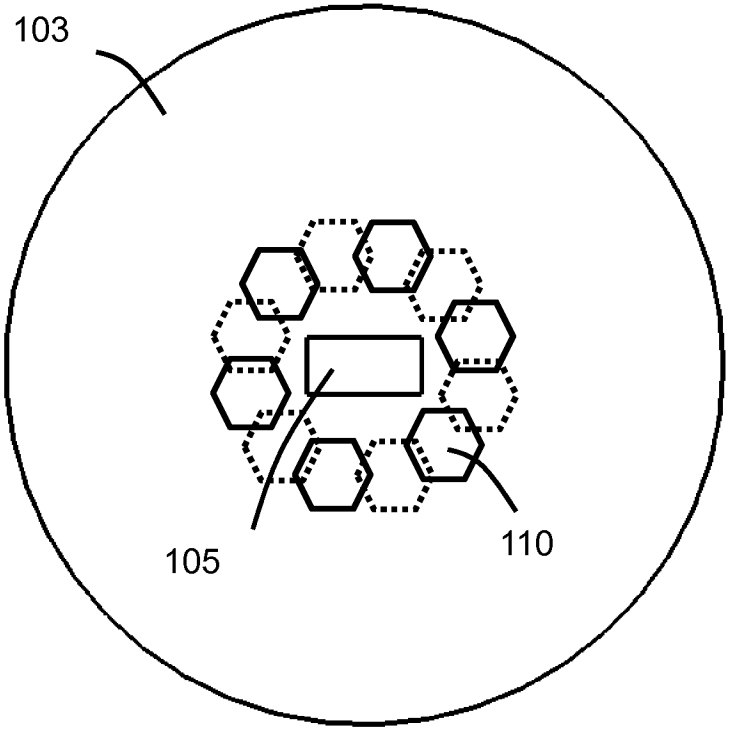
FIG. 6 is a schematic drawing illustrating an example embodiment of the flange.

The holes 110 may have any suitable shape. FIGS. 3, 4 and 5 illustrate examples with circular holes 110 and FIG. 6 illustrate an example flange 103with hexagonal shaped holes 110. However, the holes 110 may also be triangular, rectangular etc. In FIG. 6, the example number of holes 110 is 6.

Figure 7:
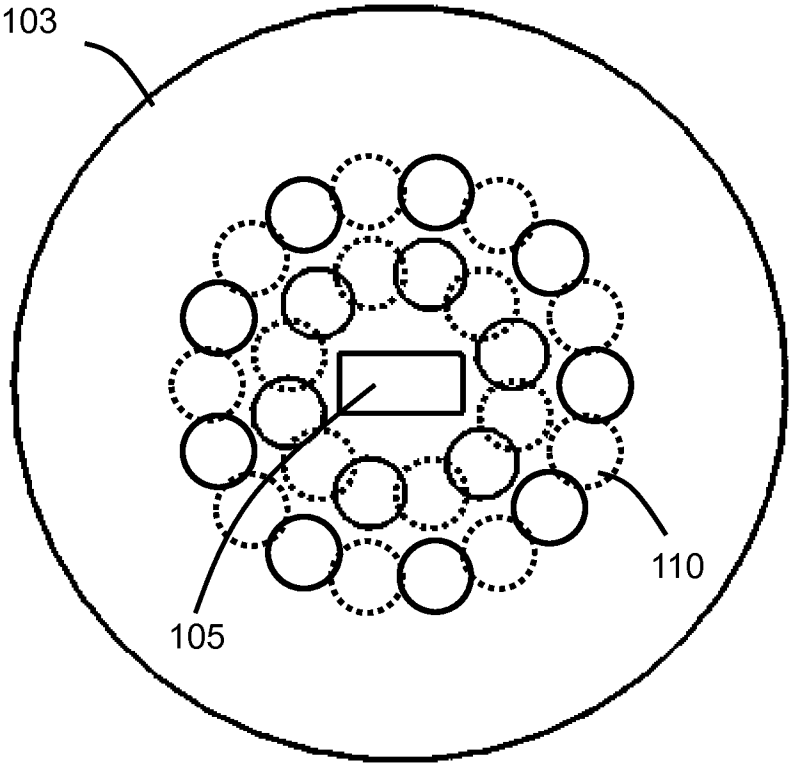
FIG. 7 is a schematic drawing illustrating an example embodiment of the flange.

The at least two holes 110 may be distributed in one, two or more rows around the end opening 105. FIGS. 3-6 described above illustrates an example where the holes 110 are distributed in one row around the end opening 105. FIG. 7 illustrates an example where the holes 110 are distributed in two rows around the end opening 105. The inner row (the row being closest to the end opening 105) comprises 16 holes 110 and the outer row (the row being further away from the end opening 105 compared to the inner row) comprises 19 holes 110. Note that two rows of holes 110 is only an example, and that a flange 103 may comprise any suitable number of rows of holes 110 and also number of holes 110.

The holes 110 may be provided to each flange 103 using any suitable method such as drilling, molding etc.

Each flange 103 may have any suitable shape, for example circular, rectangular, triangular, hexagonal etc. The flanges 103 on each waveguide 101 are preferably of the same shape. For example, the flanges 103 may be a circular disk having at least two holes 110 on each flange 103.

Each flange 103 may be of any suitable material such as metal, copper, aluminum, brass, gold, silver, metallized plastic or any other suitable material having sufficient electrical conductivity.

The two waveguides 101 are arranged to be connected to each other by connecting e.g., the first flange 103*a* to the second flanges 103*b*, such that the end openings 105*a*, 105*b* face each other and such that the holes 110 in the first flange 103*a* are at least partly glide symmetrically positioned with respect to the holes 110 in the second flange 103*b*. The connected first and second flanges 103*a*, 103*b* may then be described as mating flanges 103.

The joined flanges 103 having at least two holes 110 that are periodically distributed around the opening may form an EBG structure.

Figure 8:
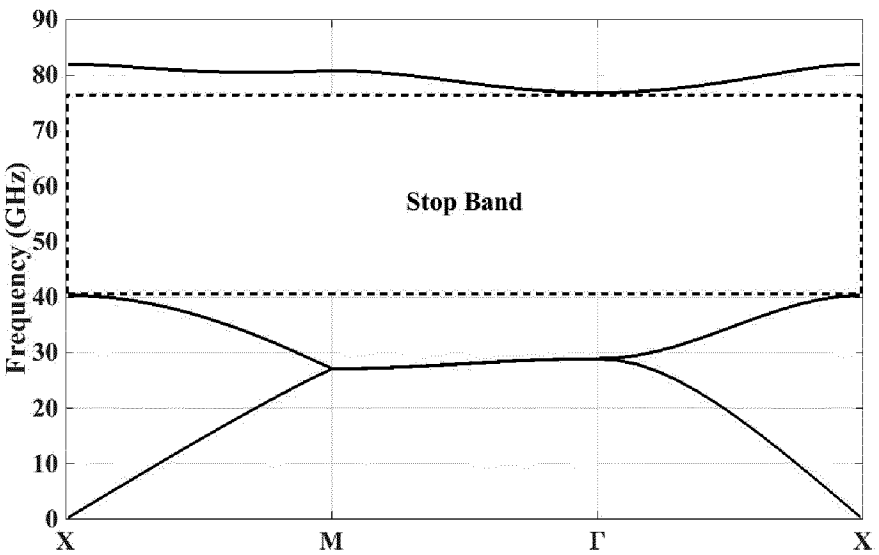
FIG. 8 is an example illustration of a holey unit cell and corresponding stopband.
Figure 8:
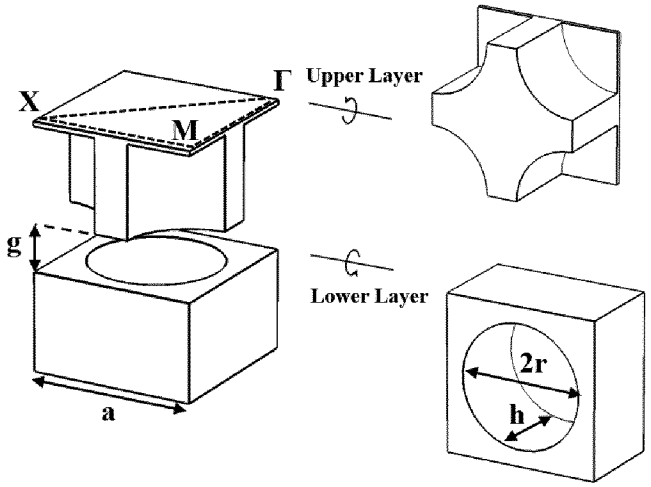

The embodiments herein use an at least partly glide symmetric periodic structure composed of for example a holey-unit cell as exemplified in FIG. 8. A unit-cell may be described as a part of the structure, that when repeated periodically, builds up the complete waveguide. For example, the unit cell can be one hole in the first flange plus two halves of two different holes in the second flange. The left part of FIG. 8 illustrates an example of a holey unit cell when a=3.5 mm, 2r=2.8 mm, h=1.5 mm and gap (g) is 0.05 mm. The right part of FIG. 8 illustrates a graph (i.e., a dispersion diagram) with the stopband corresponding to the holey unit cell in the left part. In particular, the lower and upper bounds of the stop band correspond to the Lower Layer and Upper Layer depicted in the left side of FIG. 8, respectively. The x-axis of the graph represents the boundaries of a Brillouin zone and the y-axis of the graph represents the frequency measured in GHz. The X, M, and gamma Γ in the x-axis correspond to the points shown in the holey unit-cell at the left side of FIG. 8 (X, M, and Γ are corners of a Brillouin zone). As seen in FIG. 8, the stopband is between 40 and 77 GHz. The stopband is the band between the dotted lines in FIG. 8. The solid lines in FIG. 8 represent propagating modes (i.e., different orientation of fields), the x-axis is different directions, and it is seen that there exists a frequency band (i.e., the stop band) where no modes can propagate in any direction. As seen, no wave can propagate inside the stop-band.

A stopband may be described as a band of frequencies, between specified limits, through which currents are not allowed to pass.

Figure 9:
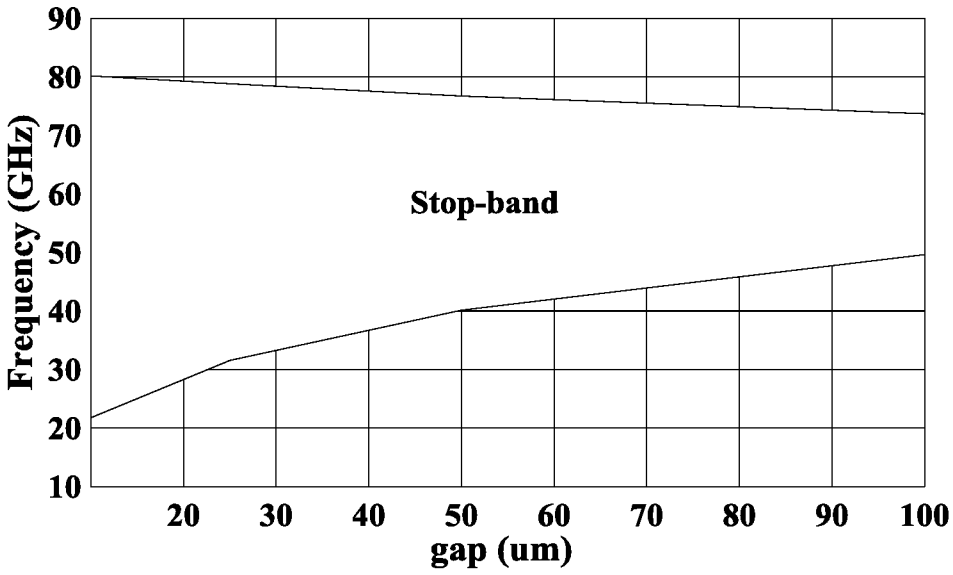
FIG. 9 is a graph illustrating the effect in the stopband for gap variations.

FIG. 9 is a graph illustrating the effect in the stopband for different gap size variations. The x-axis of FIG. 9 represents the gap measured in pm and the y-axis represents the frequency measured in GHz. With the previous example hole dimensions (i.e., the ones seen in FIG. 8), it is possible to achieve a stopband from 40 to 77 GHz where no waves are allowed to propagate within that air gap.

Figure 10:
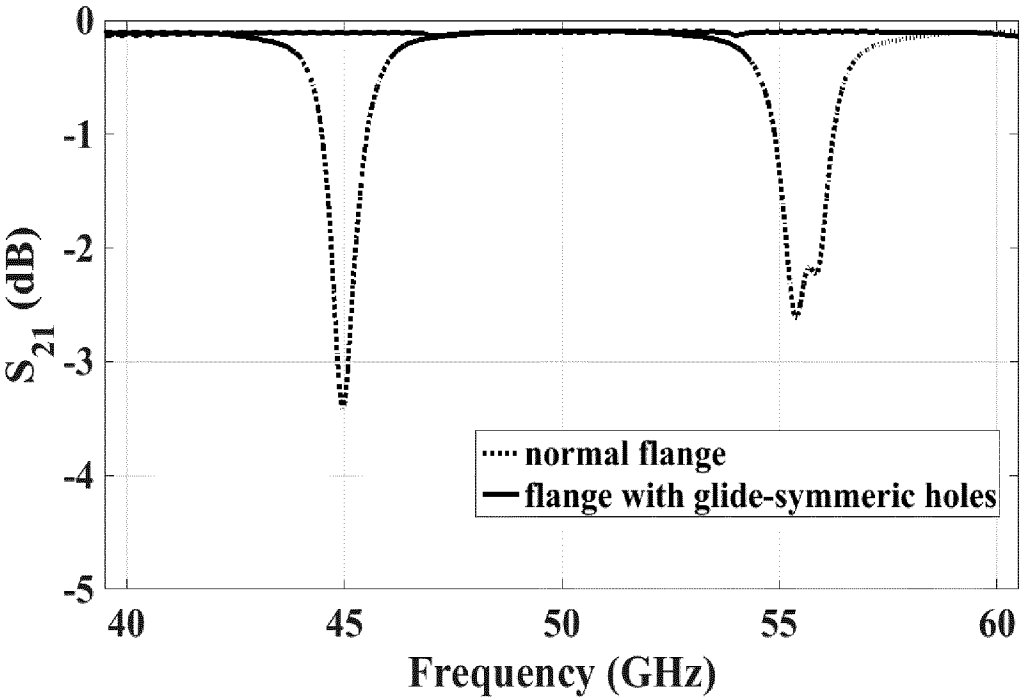
FIG. 10 is a graph illustrating the transmission in a prior art flange and a flange with a glide symmetric pattern.

FIG. 10 is a graph illustrating a comparison of the transmission in a prior art flange having a smooth surface and a flange with at least partly glide symmetric holes as in the embodiments herein in case of having a gap of 0.05 mm between the first flange and the second flange. The x-axis of FIG. 10 represents the frequency measured in GHz and the y-axis represents transmission parameter (S21) measured in dB. S21 represents the power transmitted from one waveguide 101 to the other (i.e., not through the gap between the flanges). The transmission in the prior art (normal) flange is illustrated with a dotted line and the transmission in the flange with the at least partly glide symmetric holes is illustrated with a continuous line.

Simulations of the scattering parameters of the at least partly glide symmetric flange design will now be described. The performance of the at least partly glide symmetric flange design has been compared with a prior art rectangular waveguide flange. A gap 112 of 0.05 mm between the two flanges 103 is allowed and it is possible to observe in FIG. 10 how the mismatch obtained for the prior art flange is avoided when using the at least partly glide symmetric holey flange 103. The at least partly glide symmetric holey flange 103 creates a smooth transition and all energy between the ports is transmitted without disturbances. Surface roughness caused by manufacturing or assembly tolerances would not affect the performance of the at least partly glide symmetric flange 103 but the operating bandwidth will increase as the gap 112 tends to zero, as it is shown in FIG. 9.

The method for manufacturing a first waveguide 101*a* according to some embodiments will now be described. The method comprises at least one of the following steps, which steps may as well be carried out in another suitable order than described below:

A first flange 103*a* surrounding an end opening 105*a* to the first waveguide 101*a* is provided. The first flange 103*a* comprises at least two holes 110 which are periodically distributed around the end opening 105*a*. The first waveguide 101*a* is arranged to be connected to a second waveguide 101*b* by connecting the first flange 103*a* to a second flange 103*b* of the second waveguide 101*b* such that the end opening 105*a* of the first waveguide 101*a* face an end opening 105*b* of the second waveguide 101*b* and such that the holes 110 in the first flange 103*a* are at least partly glide symmetrically positioned with respect to holes 110 which are periodically distributed around the end opening 105*b* of the second flange 103*b*.

As shown in FIG. 2-7, at least two holes 110 comprised in the first flange 103*a* may constitute a holey and at least partly glide symmetric EBG structure integrated within the first flange 103*a*. The at least two holes 110 in the first flange 103*a* may be placed in a closed shape around the end opening 105*a* of the first flange 103*a*. The at least two holes 110 in the first flange 103*a* may be periodically distributed around the end opening 105*a* of the first flange 103*a* in at least one row. Each of the at least two holes 110 on the first flange 103*a* are at least one of circular, squared or hexagonal shaped.

The at least two holes 110 on the first flange 103*a* are periodically distributed around the end opening 105*a* in a circular, a hexagonal or a polygonal form.

The first flange 103*a* may be located around an outer circumference of the first waveguide 101*a*.

The first waveguide 101*a* may be arranged to be connected to a second waveguide 101*b* such that a gap that is either zero or more than zero is located between the first flange 103*a* and the second flange 103*b* when they are connected.

Figure 11:
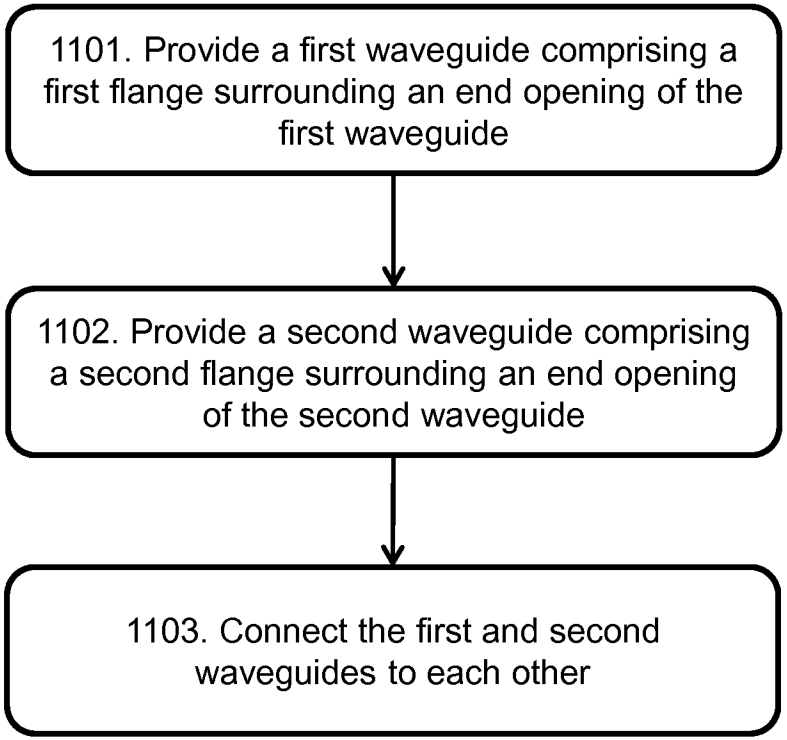
FIG. 11 is a flow chart illustrating embodiments of a method.

The method for manufacturing a waveguide assembly for waveguides 101, according to some embodiments will now be described with reference to the flowchart depicted in FIG. 11. The method comprises at least one of the following steps, which steps may as well be carried out in another suitable order than described below:

Step 1101

A first waveguide comprising a first flange surrounding an end opening of the first waveguide is provided.

Step 1102

A second waveguide comprising a second flange surrounding an end opening of the second waveguide is provided. Each flange comprises at least two holes which are periodically distributed around the respective end opening.

Step 1103

The first and second waveguides 101*a*, 101*b* are connected to each other by connecting the first flange 103*a* to the second flange 103*b* such that the end openings 105*a*, 105*b* face each other and such that the holes 110 in the first flange 103*a* are at least partly glide symmetrically positioned with respect to the holes 110 in the second flange 103*b*.

The at least two holes comprised in each flange may constitutes a holey and at least partly glide symmetric EBG structure integrated within each of the first and second flange. The at least two holes in each flange are placed in a closed shape around the respective end opening. The at least two holes in each flange may be periodically distributed around the respective end opening in at least one row. The at least two holes on each flange may be at least one of: circular, squared or hexagonal shaped. The at least two holes on each flange may be periodically distributed around each end opening in a circular, a hexagonal or a polygonal form.

The first flange may be located around an outer circumference of the first waveguide and the second flange may be located around an outer circumference of the second waveguide.

A gap that is either zero or more than zero may be located between the first flange and the second flange when the first and second flanges are connected.

Some embodiments described herein may be summarised in the following manner: A waveguide flange where a holey at least partly glide symmetric EBG structure is integrated within a waveguide flange 103. Thus, the flange 103 may be referred to as a "holey and at least partly glide symmetric flange" 103. The holey at least partly glide symmetric flange 103 is placed surrounding the waveguide end opening 105 and significantly reduces the leakage, should there be a gap 112 between the mated flanges 103. This waveguide 101 is easier to manufacture than the pin surface applied in the pin-flange since it just requires drilling holes which is much faster and easier than milling, casting, moulding, or die-sinking pins.

The embodiments herein are not limited to the above described embodiments. Various alternatives, modifications and equivalents may be used. Therefore, the above embodiments should not be taken as limiting the scope of the embodiments, which is defined by the appending claims. A feature from one embodiment may be combined with one or more features of any other embodiment.

It should be emphasized that the term "comprises/comprising" when used in this specification is taken to specify the presence of stated features, integers, steps or components, but does not preclude the presence or addition of one or more other features, integers, steps, components or groups thereof. It should also be noted that the words "a" or "an" preceding an element do not exclude the presence of a plurality of such elements. The terms "consisting of" or "consisting essentially of" may be used instead of the term comprising.

The term "configured to" used herein may also be referred to as "arranged to", "adapted to", "capable of" or "operative to".

It should also be emphasised that the steps of the methods defined in the appended claims may, without departing from the embodiments herein, be performed in another order than the order in which they appear in the claims.

The invention claimed is:

1. A method for manufacturing a waveguide assembly, the method comprising:

providing a first waveguide comprising a first flange surrounding an end opening of the first waveguide; wherein the first flange comprises at least two holes which are periodically distributed around the end opening of the first waveguide;

providing a second waveguide comprising a second flange surrounding an end opening of the second waveguide; wherein the second flange comprises at least two holes which are periodically distributed around the end opening of the second waveguide; and connecting the first and second waveguides to each other by connecting the first flange to the second flange such that the respective end openings of the first and second waveguides face each other, and such that the at least two holes of the first flange are at least partly glide symmetrically positioned with respect to the at least two holes of the second flange.

2. A first waveguide comprising:

a first flange surrounding an end opening of the first waveguide;

wherein the first flange comprises at least two holes which are periodically distributed around the end opening; and wherein the first waveguide is configured to be connected to a second waveguide, wherein the second waveguide comprises a second flange surrounding an end opening of the second waveguide and wherein the second flange comprises a corresponding at least two holes which are periodically distributed around the end opening of the second flange, by connecting the first flange to a second flange such that the end opening of the first waveguide faces the end opening of the second waveguide, and such that the at least two holes of the first flange are at least partly glide symmetrically positioned with respect to the corresponding at least two holes of the second flange.

3. The first waveguide of claim 2, wherein the first flange is located around an outer circumference of the first waveguide.

4. The first waveguide of claim 2, wherein the first waveguide is configured to be connected to the second waveguide such that a gap is located between the first flange and the second flange when the first and second flanges are connected to each other.

5. The first waveguide of claim 2, wherein the at least two holes of the first flange are circular, squared, or hexagonal shaped.

6. The first waveguide of claim 2, wherein the at least two holes of the first flange are periodically distributed around the end opening in a circular, a hexagonal, or a polygonal form.

7. The first waveguide of claim 2, wherein the first waveguide is configured to be connected to the second waveguide such that no gap is located between the first flange and the second flange when the first and second flanges are connected to each other.

8. The first waveguide of claim 2, wherein the at least two holes of the first flange are placed in a closed shape around the end opening of the first flange.

9. The first waveguide of claim 2, wherein the at least two holes of the first flange are periodically distributed around the end opening of the first flange in at least one row.

10. The first waveguide of claim 2, wherein the at least two holes of the first flange, when the first flange is connected to the second flange, constitute a holey and at least partly glide symmetric Electromagnetic Band Gap (EBG) structure integrated within the first and second flange.

11. A waveguide assembly, the waveguide assembly comprising:

a first waveguide comprising a first flange surrounding an end opening of the first waveguide; wherein the first flange comprises at least two holes which are periodically distributed around the end opening of the first waveguide;

a second waveguide comprising a second flange surrounding an end opening of the second waveguide; wherein the second flange comprises at least two holes which are periodically distributed around the end opening of the second waveguide;

wherein the first and second waveguides are configured to be connected to each other by connecting the first flange to the second flanges such that the end openings of the first and second waveguides face each other and such that the at least two holes of the first flange are at least partly glide symmetrically positioned with respect to the at least two holes of the second flange.

12. The waveguide assembly of claim 11, wherein a gap is located between the first flange and the second flange when the first and second waveguides are connected to each other.

13. The waveguide assembly of claim 11, wherein the at least two holes of each one of the first and second flanges are circular, squared, or hexagonal shaped.

14. The waveguide assembly of claim 11, wherein the at least two holes of each one of the first and second flanges are periodically distributed around each end opening of the first and second waveguides in a circular, a hexagonal, or a polygonal form.

15. The waveguide assembly of claim 11, wherein the at least two holes of each one of the first and second flanges are periodically distributed around the respective end openings of the first and second waveguides in at least one row.

16. The waveguide assembly of claim 11:

wherein the first flange is located around an outer circumference of the first waveguide; and wherein the second flange is located around an outer circumference of the second waveguide.

17. The waveguide assembly of claim 11, wherein no gap is located between the first flange and the second flange when the first and second waveguides are connected to each other.

18. The waveguide assembly of claim 11, wherein the at least two holes of each one of the first and second flanges constitutes a holey and at least partly glide symmetric Electromagnetic Band Gap (EBG) structure integrated within each of the first and second flanges.

19. The waveguide assembly of claim 11, wherein the at least two holes of each one of the first and second flanges are placed in a closed shape around the respective end openings of the first and second waveguides.

20. A method for manufacturing a first waveguide, the method comprising:

providing a first flange surrounding an end opening to the first waveguide;

wherein the first flange comprises at least two holes which are periodically distributed around the end opening; and wherein the first flange of the first waveguide is configured to be connected to a second flange of a second waveguide, wherein the second flange comprises at least two holes which are periodically distributed around an end opening of the second waveguide, by connecting the first flange to the second flange such that the end opening of the first waveguide faces the end opening of the second waveguide, and such that the at least two holes of the first flange are at least partly glide symmetrically positioned with respect to the at least two holes of the second flange.

* * * * *